US006270842B1

(12) United States Patent
Uchida et al.

(10) Patent No.: US 6,270,842 B1
(45) Date of Patent: Aug. 7, 2001

(54) METHOD OF GALVANIZING WITH MOLTEN ZINC-ALUMINUM ALLOY

(75) Inventors: Tsuneji Uchida, Chiba; Suzuo Murotani, Tokyo; Kenji Hagimori; Yuzuru Abe, both of Saitama, all of (JP)

(73) Assignees: Azuma Kogyo Co., Ltd., Yashio; Toshin Chemical Industry Co., Ltd., Tokyo (JP)

( * ) Notice: Subject to any disclaimer, the term of this patent is extended or adjusted under 35 U.S.C. 154(b) by 0 days.

(21) Appl. No.: 09/362,492

(22) Filed: Jul. 28, 1999

(30) Foreign Application Priority Data

Aug. 20, 1998 (JP) ..... 10-234317

(51) Int. Cl.[7] ..... B05D 1/18; B05D 3/10; B05D 1/36

(52) U.S. Cl. ..... 427/310; 427/320; 427/321; 427/329; 427/406; 427/433; 427/436

(58) Field of Search ..... 427/320, 321, 427/329, 310, 406, 431, 433, 436; 148/23, 24

(56) References Cited

U.S. PATENT DOCUMENTS

| | | | | |
|---|---|---|---|---|
| 2,076,712 | * | 4/1937 | Fink et al. | 427/433 |
| 2,957,782 | | 10/1960 | Boller . | |
| 3,816,188 | * | 6/1974 | Chay | 148/26 |
| 3,936,326 | * | 2/1976 | Muller | 148/26 |
| 4,140,821 | * | 2/1979 | Radtke et al. | 427/310 |
| 4,496,612 | | 1/1985 | McNutt et al. . | |
| 4,738,758 | * | 4/1988 | Renaux et al. | 204/38.5 |

FOREIGN PATENT DOCUMENTS

| | | | |
|---|---|---|---|
| 2322985 | | 11/1974 | (DE) . |
| 58-136759 | * | 8/1983 | (JP) . |
| 3-146651 | | 6/1991 | (JP) . |
| 3-162557 | | 7/1991 | (JP) . |
| 4-19299 | | 3/1992 | (JP) . |
| 6-279968 | | 10/1994 | (JP) . |
| 7-173598 | | 7/1995 | (JP) . |
| 7-224369 | | 8/1995 | (JP) . |
| 7-233459 | | 9/1995 | (JP) . |
| 2510361 | | 4/1996 | (JP) . |
| 8-188864 | | 7/1996 | (JP) . |
| 10-140310 | | 5/1998 | (JP) . |

OTHER PUBLICATIONS

*Patent Abstracts of Japan*, vol. 007, No. 252 (C–194), Nov. 9, 1983 of JP 58 136759.

*Chemical Abstracts*, vol. 99, No. 24, Dec. 12, 1983, abstract no. 199011, XP–002135413, of JP 58 136759.

* cited by examiner

*Primary Examiner*—Shrive Beck
*Assistant Examiner*—Michael Barr
(74) *Attorney, Agent, or Firm*—Frishauf, Holtz, Goodman, Langer & Chick, P.C.

(57) ABSTRACT

A steel material subjected to preliminary treatments to remove an oxide film on the surface is immersed in a molten flux bath in an independent vessel and thereafter immersed in a molten zinc-aluminum alloy bath in a separate vessel to be galvanized with a coating of the alloy. The molten flux bath consists essentially of 5–25 wt % of an alkali metal chloride, typified by sodium chloride, or an alkaline earth metal, and the balance being zinc chloride. The flux bath may additionally contain 1–5 wt % of an alkali metal fluoride typified by sodium fluoride. The method allows for inexpensive, efficient and one-stage galvanizing with a corrosion-resistant molten zinc alloy of a high aluminum content to produce a smooth, uniform and beautiful galvanized layer on the surfaces of various steel materials.

18 Claims, No Drawings

METHOD OF GALVANIZING WITH MOLTEN ZINC-ALUMINUM ALLOY

BACKGROUND OF INVENTION

1. Field of the Invention

This invention relates to a method of single-stage galvanizing of an iron or steel material with a molten zinc-aluminum alloy using a molten flux.

2. Background Information

In recent years, there is seen a growing demand for galvanizing with a molten zinc alloy of high aluminum content that shows sufficiently high corrosion resistance to withstand hostile corrosive environments and provides maintenance-free coatings. One main problem with galvanizing using a molten zinc-aluminum alloy is that black spottings (ungalvanized areas) and poorly adherent zinc-aluminum alloy layers are highly prone to occur. To deal with this problem, various galvanizing methods have been proposed, including a dry galvanizing method using a gas reduction technique, a two-stage galvanizing method and a wet galvanizing method using a zinc chloride free flux.

However, most of the galvanizing methods proposed so far are incapable of solving the aforementioned problem with galvanizing with a molten zinc alloy of high aluminum content, particularly from the viewpoint of practical applicability. First of all, dry galvanizing in a reducing gas atmosphere without using a flux has no flexibility in the materials that can be treated, since it is applicable only to the galvanizing of steel strips and wires by a continuous dipping method. In addition, large-scale production facilities are required.

Galvanizing with a molten zinc alloy can be performed in an air atmosphere using a flux. To achieve high quality galvanizing with a zinc bath of high aluminum content by an improved version of this method Examined Japanese Patent Publication (kokoku) No. 19299/1992 proposed a two-stage process which consists of ordinary galvanizing with molten zinc, followed by galvanizing with a molten zinc-aluminum alloy. However, this process is not highly cost effective from the viewpoints of facilities and operating efficiency.

The ordinary methods of galvanizing with molten zinc using a flux can be classified into a wet system and a dry system. In the wet system, a molten zinc bath is covered with a blanket molten flux layer chiefly made of zinc chloride and an iron or steel material that has been subjected to preliminary treatments to remove the oxide film is passed through the blanket flux layer to be dipped into the molten zinc bath so that it is galvanized to obtain a zinc coating. The currently used molten zinc alloy bath of high aluminum content contains either 5% or 55% of aluminum. At the interface between the flux and the molten alloy bath zinc chloride present in the blanket flux reacts with the aluminum in the bath, according to the reaction formula: $3ZnCl_2+2Al=2AlCl_3+3Zn$, thereby forming volatile aluminum chloride; the resulting aluminum chloride evaporates into the atmosphere to a cause partial loss of the aluminum ingredient of the bath while, at the same time, it prevents the galvanized layer from adhering firmly to the entire surface of the steel material (i.e., some areas remain ungalvanized with the alloy coating). To solve this problem, Japanese Patent No. 2510361 has proposed that a hot galvanizing bath consisting of 40–80% aluminum and zinc be used with a flux composition based on an alkali metal-aluminum fluoride (for example cryolite) rather than a zinc chloride-containing flux.

The wet system using a blanket molten flux that floats on the alloy bath has another problem. After the galvanizing, the galvanized article is passed through the blanket flux layer in order to be withdrawn from the galvanizing bath. As a result, the flux is prone to adhere to the surface of the galvanized layer and particularly in the case where it is chiefly made of an alkali metal-aluminum fluoride, the flux deposit is water-insoluble and therefore is not easy to remove unless certain post-treatments are applied, but then the resulting surface does not have a silvery white gloss.

In the dry galvanizing system, a steel material to be galvanized is immersed in an aqueous flux solution in a separate vessel to form a flux coating on the surface of the material to be galvanized, which is then dried and immersed in a molten zinc alloy bath. This method also has several problems. If an article to be galvanized is not thoroughly dried, black spottings (ungalvanized areas) or poorly adhered layers are prone to occur. In addition, as in the aforementioned wet system, if zinc chloride is present in the flux, the unwanted aluminum chloride will form. To solve this problem, it has been proposed to replace a portion or all of the zinc chloride with tin chloride which has a substantial surface activating action but which is expensive [see, for example, Unexamined Published Japanese Patent Application (kokai) No. 146651/191]. It has also been proposed that an organic salt be added to the flux with a view to providing better wettability [see, for example, Unexamined Published Japanese Patent Application (kokai) No. 233459/1995]. However, this approach does not provide a satisfactorily firmly adhered layer in galvanizing with the aforementioned molten zinc alloy of high aluminum content and, as a matter of fact, in an experiment made by the present inventors, black spottings (ungalvanized areas) often occurred and problems were also encountered with the operating efficiency and cost.

SUMMARY OF THE INVENTION

The present invention has been accomplished under these circumstances and has as an object providing an economical galvanizing method which does not use any special reagent but simply depends on the cleaning effect of molten zinc chloride, which prevents the loss of aluminum from a galvanizing bath and, hence the occurrence of black spottings (ungalvanized areas). Moreover, the present invention needs only one stage of galvanizing process to apply a smooth and beautiful galvanized layer of a high aluminum-zinc alloy on the surfaces of iron and steel materials.

To attain the stated object, the present inventors noted the marked cleaning effect of molten zinc chloride on an iron or steel material (hereunder often simply referred to as "a steel material") and found that a smooth and beautiful galvanized film of a zinc-aluminum alloy could be formed on the surface of a steel material by a method in which a steel material that was freed of an oxide film by ordinary preliminary treatments such as degreasing and pickling was immersed in a zinc chloride based, molten flux bath in an independent vessel, withdrawing the steel material from the flux bath and subsequently dipping it in a molten zinc-aluminum bath in a separate galvanizing vessel. The present inventors also found a flux composition suitable for use in the practice of the method.

Thus, the present invention provides a method of galvanizing with a molten zinc-aluminum alloy by immersing an oxide-film free steel material in a molten flux bath in an independent vessel and thereafter immersing the flux coated steel material in a molten zinc-aluminum alloy bath in a separate vessel to be coated with a zinc-aluminum alloy layer.

In a preferred embodiment, the molten flux bath consists essentially of at least one metal chloride selected from the group consisting of alkali metal chlorides and alkaline earth metal chlorides, and the balance being zinc chloride.

In another preferred embodiment, said at least one metal chloride selected from the group consisting of alkali metal chlorides and alkaline earth metal chlorides is sodium chloride and accounts for 5–25 wt %, preferably 5–22 wt %, and most preferably 10–20 wt % of the molten flux bath.

In yet another preferred embodiment, the molten flux bath consists essentially of at least one metal chloride selected from the group consisting of alkali metal chlorides, alkaline earth metal chlorides, an alkali metal fluoride, and the balance being zinc chloride.

In a further preferred embodiment, said at least one metal chloride selected from the group consisting of alkali metal chlorides and alkaline earth metal chlorides is sodium chloride and accounts for 5–25 wt %, preferably 5–22 wt %, and most preferably 10–20 wt % of the molten flux bath; and said alkali metal fluoride is sodium fluoride and accounts for 1–5 wt % of the molten flux bath.

In another preferred embodiment, the molten flux bath is held at 400–560° C.

EMBODIMENTS OF THE INVENTION

An iron or steel material that has been freed of the surface oxide film by preliminary treatments is immersed in a molten flux bath in an independent vessel, whereupon the material to be galvanized is made sufficiently clean by the cleaning action of the molten high temperature zinc chloride in the flux, so that the withdrawn material, although it has a zinc chloride layer deposited thereon, can be immediately immersed in a molten zinc alloy bath in a separate vessel, whereupon an alloy coating readily forms on the material. Thereafter, the material may be withdrawn as such to yield an article having a smooth and beautiful coating of a zinc-aluminum alloy on the surface.

In the present invention, the molten flux bath and the molten zinc alloy bath are held in separate vessels, so the temperatures of the two baths can be controlled independently of each other. The temperature of the molten flux bath in an independent vessel must be higher than the melting point of the flux composition. If it is 400° C. and lower, more of the flux is deposited on the material to increase its carryover and, hence, the consumption of the flux; in addition, an increased amount of white smoke develops in the galvanizing bath and the chance of the occurrence of black spottings (ungalvanized areas) also increases. If the temperature of the molten flux bath is 560° C. and higher, zinc chloride is lost into the atmosphere by evaporation. For these reasons and from an operational viewpoint, the preferred range of the temperature of the molten flux bath is between 400 and 560° C.

The temperature of the molten zinc-aluminum alloy bath in a separate dip galvanizing vessel depends on the aluminum content of the alloy. With a zinc-55% aluminum alloy, temperatures of about 625° C. are preferred. Compared to a zinc bath, the surface of the zinc-aluminum alloy bath undergoes less oxidation with air and is covered with a only thin oxide film. As already mentioned, in the case of galvanizing by a conventional wet method (hot dipping process) in which a blanket molten flux layer floats on a zinc bath, the galvanized material is passed through the molten flux layer to be withdrawn from the zinc bath and, hence, suffers from the disadvantage that the flux easily deposits on the surface of the galvanized layer. In the present invention, the galvanized material is simply withdrawn after the removal by skimming of the thin oxide film on the surface of the galvanizing bath and, a galvanized layer having a clean and smooth surface without any flux deposits can be easily obtained.

The flux composition may consist solely of zinc chloride. However, due to extensive evaporation of zinc chloride, the working environment is contaminated to cause various problems such as the clogging of the bag of a dust collector. To deal with this difficulty, the flux composition is typically adjusted to consist essentially of 5–25 wt %, preferably 5–22 wt % and most preferably 10–20 wt %, of a chloride of an alkali metal such as sodium, potassium or lithium or a chloride of an alkaline earth metal such as calcium or magnesium, 1–7 wt %, preferably 1–5 wt %, of a fluoride of an alkali metal such as sodium, potassium or lithium and the balance being zinc chloride. Chlorides of alkali metals are typified by sodium chloride, and fluorides of alkali metals are typified by sodium fluoride. When in a high temperature molten state, particularly at a temperature in the range of 400–560° C., zinc chloride has an outstanding cleaning effect on the surfaces of iron or steel materials. The addition of chlorides of alkali metals or alkaline earth metals not only lowers the melting point of the flux, but also proves surprisingly effective in suppressing the evaporation of zinc chloride; they also have a cleaning effect and a flux fluidizing action, as well as serve to be a partial substitute for the zinc chloride as an extender. Fluorides of alkali metals also have a cleaning effect and a flux fluidizing action; in addition, they are effective in enhancing the gloss of the galvanized surface.

If the chlorides of alkali metals or alkaline earth metals are added in amounts less than 5 wt %, they are not highly effective in suppressing the evaporation of zinc chloride; if their addition exceeds 25 wt %, the melting point of the flux increases to increase the chance of its deposition on the iron or steel materials and the occurrence of black spottings (ungalvanized areas). If the alkali metal fluorides are also added in preferred amounts of 1–5 wt %, more preferably about 3wt %, the gloss of the galvanized surface can be improved. No significant improvement in the gloss can be achieved if less than 1 wt % of the alkali metal fluorides is added; if they are added in more than 7 wt %, black spottings (ungalvanized areas) are prone to occur. Needless to say, it is within the scope of the invention to use two or more alkali metal or alkaline earth metal chlorides in combination in the flux.

Examples of the steel material to be galvanized by the galvanizing method of the invention include low carbon steels, ultra-low carbon steels, titanium steels, chromium steels and stainless steels. The galvanizing method of the invention is applicable not only to steel structures or related components thereof, but also to sheets and wires; therefore, the applicability of the invention method covers both batchwise and continuous operations, The following examples are provided to further illustrate the invention but are in no way to be taken as limiting.

EXAMPLE 1

Five sections 70 mm wide and 150 mm long were cut from a 2.3 -mm thick rolled steel sheet for general-purpose structures. A hole with a diameter of 8 mm was made at an end of each section to prepare a test piece. The thus prepared five test pieces were held with a hanger passed through the hole, degreased by immersion in a heated 10 wt % aqueous sodium hydroxide solution for 5 min, rinsed with water, pickled by immersion in a 15 wt % aqueous HCl solution for 15 min and rinsed with hot water. The test pieces thus cleaned by these preliminary treatments were immersed for 1 min in five molten flux baths in vessels that were prepared according to the recipes shown in Table 1 and which were held at 480° C. After the treatment with these fluxes, the test pieces were withdrawn and immediately immersed in a molten galvanizing bath that consisted of 1.6 wt % silicon, 55 wt % aluminum and the balance being zinc and which was held at 600–630° C. After 3 -min galvanizing in this bath, the oxide on the surface of the galvanizing bath was skimmed and the five test pieces were withdrawn and left to cool. The test pieces were visually checked for the presence of any black spottings (ungalvanized areas) and the adhesion of the galvanized layer on the material was investigated by a 0T bend test.

The results of the visual check of the exterior appearance of each of the five test pieces (sample Nos. 1–5) and the 0T bend test are also shown in Table 1.

Not a single black spotting (ungalvanized area) was found in the galvanized surfaces five test pieces prepared in accordance with the invention; they all had a beautiful metallic gloss and no peeling of the galvanized layer occurred in the 0T bend test.

TABLE 1

| Sample No. | | Composition of molten flux, wt % $ZnCl_2$ | NaCl | NaF | Exterior appearance of the galvanized surface | 0T bend test |
|---|---|---|---|---|---|---|
| Example 1 | 1 | 90 | 10 | 0 | ○ | Acceptable |
| | 2 | 85 | 15 | 0 | ○ | Acceptable |
| | 3 | 80 | 20 | 0 | ○ | Acceptable |
| | 4 | 82 | 15 | 3 | ○ | Acceptable |
| | 5 | 80 | 15 | 5 | ○ | Acceptable |
| Comparative Example 1 | 6 | 100 | 0 | 0 | ○ | Acceptable |
| | 7 | 95 | 5 | 0 | ○ | Acceptable |
| | 8 | 77 | 23 | 0 | Δ | Acceptable |
| | 9 | 72 | 28 | 0 | Δ | Acceptable |
| | 10 | 54 | 46 | 0 | Δ | Acceptable |
| | 11 | 78 | 15 | 7 | x | Non-acceptable |

Notes:
◎ No areas left ungalvanized.
Δ A very few ungalvanized areas.
x More than 30% of the entire surface was ungalvanized.

Comparative Example 1

Six test pieces were prepared from the same steel sheet of the same thickness as used in Example 1. They also had the same dimensions as in Example 1. They were galvanized with molten alloy under the same conditions as in Example 1, except that the molten flux baths were outside the recipe specified by the invention. The six test pieces designated Sample Nos. 6–11 were visually checked for their exterior appearance and subjected to a 0T bend test. The results are shown in Table 1 together with the compositions of the molten flux baths used.

Sample Nos. 6 and 7 had no ungalvanized areas but zinc chloride evaporated extensively from the molten flux. Sample Nos. 8–10 had several ungalvanized areas observed in the surface of the galvanized layer. Sample No. 11 was galvanized using a molten flux bath containing an excessive amount of sodium fluoride and almost all surface of the steel material remained ungalvanized.

EXAMPLE 2

A steel bolt 60 mm long was degreased and pickled under the same conditions as in Example 1. Thereafter, the bolt was immersed for 3 min in a molten flux bath that consisted of 85 wt % zinc chloride and 15 wt % sodium chloride and which was held at 500° C. Thereafter, the bolt was withdrawn and immediately immersed in a molten galvanizing bath that consisted of 1.6 wt % silicon, 55 wt % aluminum and the balance zinc which was held at 610° C. After 3-min immersion, the oxide film on the surface of the galvanizing bath was removed by skimming and the bolt was withdrawn; after removing the excess galvanized alloy with a centrifuge, the bolt was left to cool. The surface of the galvanized layer on the bolt as a test piece had a beautiful, smooth metallic gloss with no ungalvanized areas. In a salt spray test, for 240 h, the bolt developed no white rust and its weight loss due to corrosion was 0.042 $g/m^2$.

Comparative Example 2

A steel bolt of the same length as used in Example 2 was degreased and pickled under the same conditions as in Example 1. This test piece was immersed for 30 sec in an aqueous solution containing 12.6 wt % zinc chloride and 15.4 wt % ammonium chloride at 80° C. Thereafter, the bolt was withdrawn, dried and galvanized in a usual molten zinc bath held at 480° C. In a salt spray test, the bolt developed white rust in 168 h and its weight loss due to corrosion was 0.473 $gm/^2$.

Thus, it was verified that far better corrosion resistance was imparted to the galvanized bolt of Example 2 in which the treatment in the molten flux bath of the composition specified by the invention in an independent vessel was followed by galvanizing with a molten zinc alloy.

Comparative Example 3

A test piece of steel sheet having the same dimensions as in Example 1 was degreased and pickled as in Example 1. Thereafter, the test piece was immersed in an aqueous solution containing 28 wt % zinc chloride and 4.6 wt % sodium chloride at 80° C. for 3 min, dried with hot air at 200° C. and immersed for 3 min in a molten alloy galvanizing bath that consisted of 1.6 wt % silicon, 55 wt % aluminum and the balance zinc and which was held at 620° C. Subsequently, the oxide film on the surface of the galvanizing bath was removed by skimming and the test piece was withdrawn and left to cool.

The entire surface of the test piece remained ungalvanized.

Example 3

A test piece of steel sheet having the same dimensions as in Example 1 was degreased and pickled as in Example 1. Thereafter, the test piece was coated with a flux as in Example 2 and immersed for 3 min in a molten galvanizing bath that consisted of 5.0 wt % aluminum and the balance zinc and which was held at 450° C. The galvanizing bath was prepared from electrolytic zinc metal and 99.7 wt % aluminum metal. Thereafter, the oxide film on the surface of the galvanizing bath was removed by skimming and the test piece was withdrawn. The test piece had no visible defects such as ungalvanized areas occurring in the surface of the galvanized layer but it presented a beautiful metallic gloss.

According to the present invention, galvanizing with a zinc alloy of high aluminum content is performed on a steel material after it is immersed in a molten flux bath in a separate vessel; this is effective in preventing the occurrence of ungalvanized areas on the material and a smooth and beautiful galvanized film without any defects can be obtained by a single stage of alloy galvanizing. In addition, the use of a separate flux vessel from the galvanizing vessel allows for the temperature of the flux bath to be controlled independently of the galvanizing bath and this provides ease in management of the galvanizing operation. What is more, as demonstrated by the Examples, the galvanizing with a zinc alloy of high aluminum content can be accomplished efficiently through one stage. The advantage of using inexpensive zinc chloride as a flux combines with another feature of the invention method that it can be implemented at a lower equipment cost than the other methods, thus leading to better cost effectiveness.

The molten flux bath in a separate vessel is prepared from a flux that is based on zinc chloride and which also contains an alkali metal chloride or an alkaline earth metal chloride, with the optional addition of an alkali metal fluoride. Because of the use of two separate vessels, the molten flux bath inhibits the formation of easily volatile aluminum chloride during galvanizing by a hot dipping process; in addition, the molten flux of zinc chloride effectively contributes to an enhanced cleaning action; these actions combine with the gloss imparting effect of the alkali metal fluoride to provide a marked advantage in that steel materials of various shapes and dimensions can be galvanized with zinc alloys of high aluminum content to produce a smooth and beautiful finished surface. The composition of the high aluminum-zinc alloys which can suitably apply to iron or steel materials according to the present invention should by no means be limited to specific ones disclosed in the present application, but include any of the ordinary high aluminum-zinc alloys having compositions comprising 5–80 wt % aluminum and the balance being zinc optionally comprising additional elements such as silicon, magnesium, rare earth elements, etc. which are known as useful additives for improving the characteristic properties of the galvanized layers.

What is claimed is:

1. A method of galvanizing with a molten zinc-aluminum alloy comprising immersing an oxide-film free iron or steel material in a molten flux bath in a first vessel, said molten flux bath consisting essentially of 80 to 90 wt % of zinc chloride and 10 to 20 wt % of at least one metal chloride selected from the group consisting of an alkali metal chloride and an alkaline earth metal chloride and optionally an alkali metal fluoride, said molten flux bath being maintained at a temperature of 400 to 560° C., and thereafter immersing the resultant flux coated iron or steel material in a bath containing a molten zinc-aluminum alloy in a second vessel to coat the resultant flux coated iron or steel material with a zinc-aluminum alloy layer, said molten zinc-aluminum alloy being a zinc alloy of a high aluminum content comprising 5–80 wt % aluminum and the balance being zinc and optionally comprising one, or two or more additional elements selected from the group consisting of silicon, magnesium and a rare earth element.

2. The method according to claim 1, wherein said at least one metal chloride selected from the group consisting of an alkali metal chloride and an alkaline earth metal chloride is an alkali metal chloride which is sodium chloride.

3. The method according to claim 1, wherein said molten flux bath consists essentially of 80–90 wt % of zinc chloride, 10 to 20 wt % of at least one metal chloride selected from the group consisting of an alkali metal chloride and an alkaline earth metal chloride and 1–5 wt % of an alkali metal fluoride.

4. The method according to claim 3, wherein said at least one metal chloride selected from the group consisting of an alkali metal chloride and an alkaline earth metal chloride is an alkali metal chloride which is sodium chloride and said alkali metal fluoride is sodium fluoride.

5. The method according to claim 1, wherein said molten zinc-aluminum alloy is a zinc alloy of a high aluminum content comprising 5 wt % of aluminum.

6. The method according to claim 2, wherein said molten zinc-aluminum alloy is a zinc alloy of a high aluminum content comprising 5 wt % of aluminum.

7. The method according to claim 3, wherein said molten zinc-aluminum alloy is a zinc alloy of a high aluminum content comprising 5 wt % of aluminum.

8. The method according to claim 4, wherein said molten zinc-aluminum alloy is a zinc alloy of a high aluminum content comprising 5 wt % of aluminum.

9. The method according to claim 1, wherein said molten zinc-aluminum alloy is a zinc alloy of a high aluminum content comprising 55 wt % of aluminum.

10. The method according to claim 2, wherein said molten zinc-aluminum alloy is a zinc alloy of a high aluminum content comprising 55 wt % of aluminum.

11. The method according to claim 3, wherein said molten zinc-aluminum alloy is a zinc alloy of a high aluminum content comprising 55 wt % of aluminum.

12. The method according to claim 4, wherein said molten zinc-aluminum alloy is a zinc alloy of a high aluminum content comprising 55 wt % of aluminum.

13. The method according to claim 1, wherein the molten flux bath contains 1 to 7 wt % of an alkali metal fluoride selected from the group consisting of sodium fluoride, potassium fluoride and lithium fluoride.

14. The method according to claim 1, wherein the molten flux bath contains 3 wt % of sodium fluoride.

15. The method according to claim 1, wherein the zinc chloride is in an amount of 80 wt %.

16. The method according to claim 1, wherein the zinc chloride is in an amount of 82 wt %.

17. The method according to claim 1, wherein the zinc chloride is in an amount of 85 wt %.

18. The method according to claim 1, wherein the zinc chloride is in an amount of 90 wt %.

* * * * *